US011453983B2

(12) United States Patent
Oetken et al.

(10) Patent No.: US 11,453,983 B2
(45) Date of Patent: Sep. 27, 2022

(54) VIBRATION CONTROL SYSTEM, APPARATUS, AND METHOD FOR COMPACTOR

(71) Applicant: Caterpillar Paving Products Inc., Brooklyn Park, MN (US)

(72) Inventors: Nicholas A. Oetken, Brooklyn Park, MN (US); John Lee Marsolek, Watertown, MN (US); Michael William Ries, Andover, MN (US); Bryan J. Downing, Champlin, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 139 days.

(21) Appl. No.: 16/938,567

(22) Filed: Jul. 24, 2020

(65) Prior Publication Data

US 2022/0025589 A1 Jan. 27, 2022

(51) Int. Cl.
*E01C 19/28* (2006.01)

(52) U.S. Cl.
CPC ..... *E01C 19/282* (2013.01); *E01C 19/288* (2013.01)

(58) Field of Classification Search
CPC ..... E01C 19/282; E01C 19/288
USPC ..... 404/84.5–84.8, 117
See application file for complete search history.

(56) References Cited

U.S. PATENT DOCUMENTS

| | | | | |
|---|---|---|---|---|
| 3,909,147 | A | 9/1975 | Takata | |
| 4,105,356 | A * | 8/1978 | Loveless | E01C 19/286 404/117 |
| 4,157,877 | A * | 6/1979 | Lee | E01C 19/231 172/395 |
| 5,164,641 | A * | 11/1992 | Quibel | E01C 19/288 318/128 |
| 5,520,862 | A | 5/1996 | Face, Jr. et al. | |
| 6,122,601 | A * | 9/2000 | Swanson | E01C 19/288 702/33 |
| 6,236,923 | B1 * | 5/2001 | Corcoran | E01C 19/27 701/50 |
| 7,669,458 | B2 * | 3/2010 | Commuri | G01N 33/42 73/32 A |
| 7,676,804 | B2 | 3/2010 | Ferguson et al. | |
| 8,608,403 | B2 | 12/2013 | Thiesse | |
| 8,965,638 | B2 | 2/2015 | Ries et al. | |
| 9,299,247 | B2 | 3/2016 | O'Neal et al. | |
| 9,765,488 | B2 | 9/2017 | Oetken | |
| 10,718,093 | B2 * | 7/2020 | McAlpine | G06Q 10/06313 |
| 10,801,167 | B2 * | 10/2020 | Laugwitz | E01C 19/288 |

(Continued)

*Primary Examiner* — Raymond W Addie
(74) *Attorney, Agent, or Firm* — Xsensus, LLP

(57) ABSTRACT

A compactor vibration system, apparatus, and method that selectively provide access to vibration control settings. The control can include receiving a setting for a first set of selectable amplitudes of vibration force at which to operate a vibratory system for a first predetermined amount of time, operating the vibratory system during the first predetermined amount of time by inducing the vibration force at amplitudes by the vibratory system, wherein the amplitudes of the vibration force are selected from among the first set of selectable amplitudes, and after the first predetermined amount of time, changing the setting to a second set of selectable amplitudes of the vibration force that is different from the first set of selectable amplitudes.

20 Claims, 16 Drawing Sheets

(56) References Cited

U.S. PATENT DOCUMENTS

| | | | | |
|---|---|---|---|---|
| 2003/0047003 | A1* | 3/2003 | Miyamoto | E01C 19/288 73/660 |
| 2009/0126953 | A1* | 5/2009 | Anderegg | E02D 3/074 172/1 |
| 2010/0111605 | A1* | 5/2010 | Sturos | E01C 19/288 404/117 |
| 2010/0215434 | A1* | 8/2010 | Wolf | E01C 19/288 404/117 |
| 2015/0268218 | A1* | 9/2015 | Troxler | G01N 9/24 342/21 |
| 2017/0175345 | A1* | 6/2017 | Oetken | E02D 3/02 |
| 2020/0256775 | A1* | 8/2020 | White | G01N 3/14 |

* cited by examiner

VIBRATION CONTROL SYSTEM, APPARATUS, AND METHOD FOR COMPACTOR

TECHNICAL FIELD

The present disclosure is directed to vibration control for various size compactors, and in particular to a vibration control system, apparatus, and method that can set combinations of selectable vibration frequencies and/or amplitudes for vibratory compactors.

BACKGROUND

Compactor machines, also referred to as compaction machines, are typically employed for compacting fresh laid asphalt, dirt, gravel, and other compactable materials. During construction of roadways, highways, parking lots, and the like, loose asphalt is deposited and spread over the surface to be paved. One or more compactors travel over the surface whereby the weight of the compactor compresses the asphalt to a solidified mass. The asphalt has the strength to accommodate significant vehicular traffic and, in addition, provides a smooth, contoured surface that may facilitate traffic flow and direct rain and other parcipitation from the road surface. Compactors are also utilized to compact soil or recently laid concrete at construction sites and on landscaping projects to produce a densified, rigid foundation on which other surfaces may be built.

Compactor machines may also apply vibration for compacting. In this disclosure, a compactor machine that applies vibration may be referred to as a vibratory compator. Thick roads or parking lots may require a relatively large amount of vibration. Thin asphault laid on top of an existing road or parking surface may require a lower amount of vibration. Other surfaces such as landfils or loose dirt or gravel may require a specific level of vibration.

Roads or parking lots may require a particular amplitude and frequency of vibration, or adjustments may need to be made to amplitude and frequency between different surface conditions. For example, a jobsite may have several different work areas which require applying a first compaction effort to a first work area, then moving the compactor to a second work area and applying a second compaction effort to the second work area. Limited settings for frequency of vibration and/or amplitude of vibration may not meet the needs of a particular job.

U.S. Pat. No. 9,765,488 ("the '488 patent") describes one type of vibratory compactor. The vibratory compactor in the '488 patent is a drum-type compactor having one or more drums adapted to compact material over which the compactor is driven. In order to compact the material, the vibratory compactor includes a drum assembly having a variable vibratory mechanism that, for example, includes inner and outer eccentric weights arranged on a rotatable shaft situated within a cavity of the inner eccentric weight. According to the '488 patent, amplitude and frequency of vibration (also referred to as compaction effort) are typically controlled to establish the degree of compaction. Amplitude is typically controlled by a transversely moveable linear actuator adapted to axially bear against an axially translatable key shaft, causing the key shaft to rotate. The rotation of the key shaft, in turn, alters relative positions of the inner and the outer eccentric weights to vary amplitude of vibration created within the drum. Frequency of vibration is controlled by changing the speed of a drive motor positioned within the compactor drum. Compaction effort is adjusted by the operator by either selecting the amplitude, frequency, or amplitude and frequency over a full range of amplitudes and frequencies. However, a vibration compactor that provides an operator with a choice of a full range of amplitudes and frequencies may provide substantially more choices than are needed by an operator, may result in unnecessary complexity in selecting amplitudes and frequencies to accomplish a job, and subsequently may lead to excessive cost.

SUMMARY

A first aspect is a vibratory compactor, comprising: a frame; a cylindrical drum coupled to the frame; a shaft extending concentrically at least through a center of the drum, the shaft having a first end and a second end opposite the first end; a vibratory system rotatably positioned within the drum to induce a vibration force on the drum; and a control system configured to: receive a setting for a first set of selectable amplitudes of the vibration force for a first predetermined amount of time, operate the vibratory compactor during the first predetermined amount of time by inducing the vibration force at amplitudes by the vibratory system, wherein the amplitudes of the vibration force are selected from among the first set of selectable amplitudes, and after the first predetermined amount of time, change the setting to a second set of selectable amplitudes of the vibration force that is different from the first set of selectable amplitudes.

Another aspect is a system for enabling project specific features on an asphalt compactor, comprising: a remote setting device configured to remotely set a vibration force of the asphalt compactor to a first group of selectable amplitudes of the vibration force for a first predetermined amount of time; and a control system configured to: receive, via a secure connection with the remote setting device, the setting for the first group of selectable amplitudes of the vibration force for the first predetermined amount of time, operate the asphalt compactor during the first predetermined amount of time by selecting one or more vibration amplitudes from among the selectable vibration amplitudes of the first group and apply the vibration force to asphalt at the selected one or more vibration amplitudes, and at expiration of the first predetermined amount of time, change the setting of the vibration force to a second group of selectable amplitudes of the vibration force that is different from the first group of selectable amplitudes, wherein a total number of the selectable amplitudes of the first group of selectable amplitudes is greater than a total number of selectable amplitudes of the second group of selectable amplitudes.

And yet another aspect is a method of managing asphalt compactor features, comprising: receiving, via secure access, a setting for a first number of selectable amplitudes of a vibration force and a first number of selectable frequencies of vibration to be applied by the asphalt compactor to asphalt for a first predetermined amount of time; operating the asphalt compactor during the first predetermined amount of time by applying amplitudes and frequencies of vibration force, selected from the first number of selectable amplitudes and the first number of selectable frequencies of the vibration force, to the asphalt; and at expiration of the first predetermined amount of time, changing the setting to a second number of selectable amplitudes of the vibration force and a second number of selectable frequencies of the vibration force that are different from the first number of selectable amplitudes of the vibration force and the first number of frequencies of the vibration force, respectively.

The foregoing general description of the illustrative embodiments and the following detailed description thereof are merely exemplary aspects of the teachings of this disclosure, and are not restrictive.

BRIEF DESCRIPTION OF THE DRAWINGS

A more complete appreciation of this disclosure and many of the attendant advantages thereof will be readily obtained as the same becomes better understood by reference to the following detailed description when considered in connection with the accompanying drawings, wherein.

DETAILED DESCRIPTION

Aspects of this disclosure are directed to systems, apparatuses, and methods of administrative control of parameter settings for a vibratory compactor over combinations of vibration amplitudes and/or frequencies. The administrative control can switch between combinations of vibration amplitude and frequency, including selectively providing more combinations or less combinations, depending upon certain criteria or circumstances. Some aspects include automatic adjustment of vibration amplitude and/or frequency. Some aspects include automatic adjustment of vibration amplitude and frequency based on feedback from a compaction sensor, as well as providing information as to whether further compaction is needed. Some aspects include a controller (e.g., control circuitry and/or including a processor) for the vibratory compactor in communication with a remote device having an interface to enable or disable the specific vibration amplitudes and frequencies for the vibratory compactor to accomplish one or more jobs.

Figure 1:
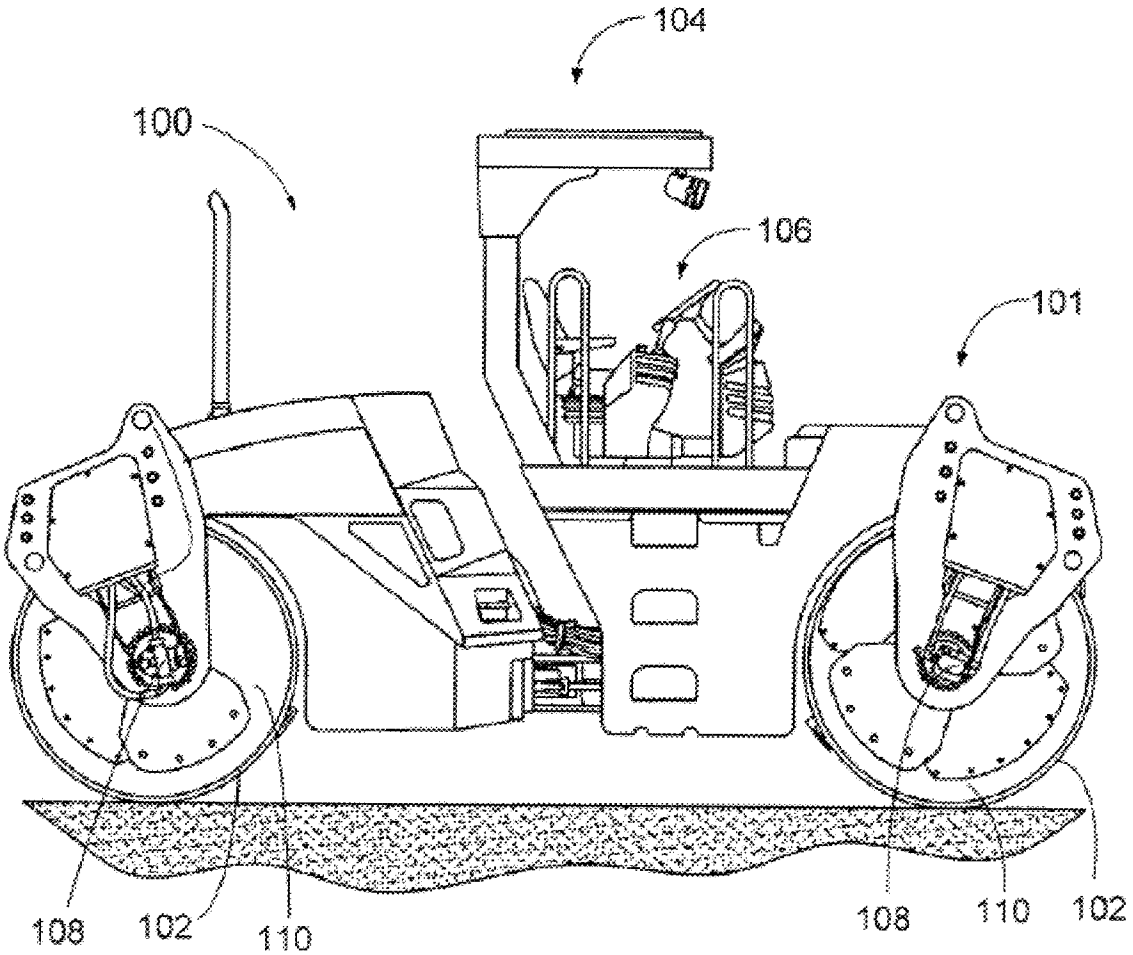
FIG. 1 is an outline view of one example of a compactor machine having a vibratory compactor assembly in accordance with the disclosure.

An exemplary embodiment of a compactor or compaction machine 100 is shown generally in FIG. 1. The compaction machine 100 can have a vibratory compactor assembly 101 included within one or more of drums 102. Though FIG. 1 shows the compaction machine 100 with two drums 102, embodiments of the disclosed subject matter can replace one of the drums 102 with a set of one or more tires.

The compaction machine 100, generally, has an operator area 104, such as a cab or roll over protective structure as shown in FIG. 1, containing various controls 106 that allow an operator to control the compaction machine 100, as shown in FIG. 1. The various controls 106 can be used to control the direction and speed of the compaction machine's 100 travel, as well as various other systems including the operation of the vibratory compactor assembly 101. While the arrangement in FIG. 1 is illustrated in connection with a vibratory asphalt compactor, the arrangement disclosed herein has applicability in various other types of vibratory compactors as well, such as combination compactors (i.e., tires and drums), as alluded to above. Other vibratory compactors may be for compaction of other materials including dirt, gravel, and other compactable materials. Hence, though the compaction machine 100 is shown with two drums 102, compactors with more or fewer drums 102 are contemplated (e.g., only one drum 102).

Each drum 102, which can be cylindrical, can be connected to the compaction machine 100 by one or more axles 108. The drums 102 can connect to the axles 108 at caps 110 of each drum 102, which may be circular, such as shown in FIG. 1. The axles 108 can rotatably connect the drum 102 to the compaction machine 100 and also act as conduits for various utility lines such as electricity, pneumatics, or hydraulics to reach the interior of the drum 102.

Figure 2:
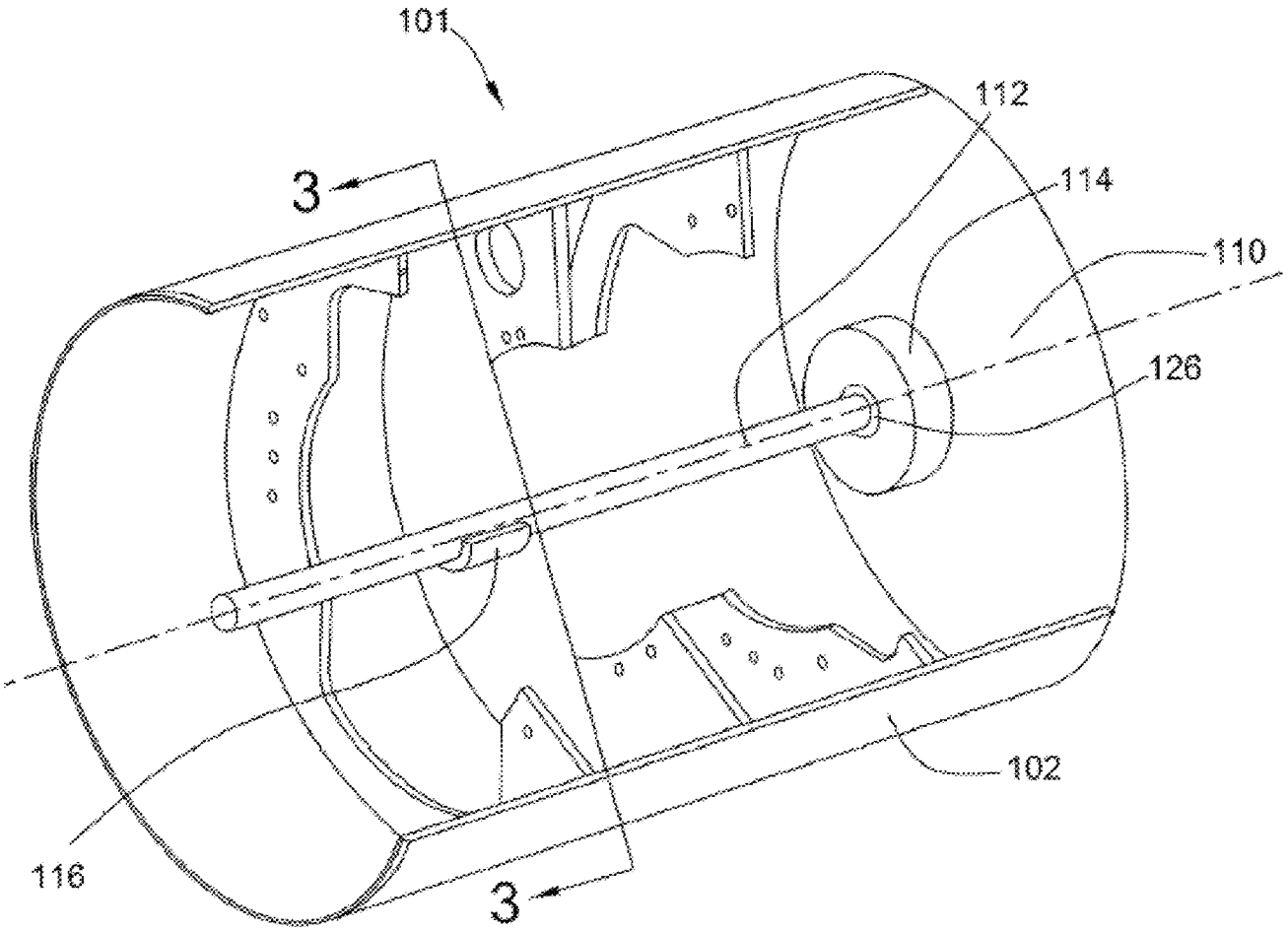
FIG. 2 is a cutaway perspective view of a drum of the vibratory compactor assembly of FIG. 1.

FIG. 2 shows the interior of drum 102 in vibratory compactor assembly 101. A shaft 112, which can have a first end and a second end opposite the first end, passes through the longitudinal axis of the drum's 102 interior and, in some embodiments, the shaft 112 is configured to rotate around the longitudinal axis. In some embodiments, the first and second ends of the shaft 112 connect to the caps 110 of the drum 102 at a rotary bearing, which can allow the shaft 112 to rotate independently of the drum 102. While the shaft 112 in FIG. 2 is shown to have a generally cylindrical shape, shafts having other shapes can also be implemented.

The shaft 112 can have at least one sensor 116, which may be an electromagnet such as shown in FIG. 2, attached to a portion of the shaft's 112 circumference. For example, FIG. 2 shows the electromagnet 116 on a portion of the shaft 112 facing downward. In one embodiment, a motor 114 causes the shaft 112 to rotate in a direction opposite the rotation of the drum 112 such that the electromagnet 116 maintains a consistent orientation with respect to the ground. For instance, the consistent orientation may be that the electromagnet 116 always faces the same way or substantially the same way, even during rotation of the drum 102. Though FIG. 2 shows the at least one sensor in the form of electromagnet 116, embodiments of the disclosed subject matter are not so limited, and the at least one sensor can be a proximity sensor, a hall effect sensor, a potentiometer, a linear transducer, and an encoder. The motor 114 represented in FIG. 2, alternatively, can be a gearing mechanism 114. The gearing mechanism 114 causes the shaft 112 to rotate opposite to the drum 102. Such a gearing mechanism 114 can link to the drum 102 and the shaft 112, and be geared such that the shaft 112 rotates at the same rate as the drum 102, but in the opposite direction.

A result of using either a motor 114 or a gearing mechanism 114 is that the shaft 112 can rotate relative to the drum 102 but may not rotate relative to the ground or the rest of the compaction machine 100. In other embodiments, the shaft 112 can be weighted such that a majority (e.g., 50% or more, 75% or more, etc.) of the shaft's 112 weight is on the bottom portion of the shaft's 112 cross section and the shaft 112 is allowed to rotate independently of the drum 102. In this way, the force of gravity on the shaft 112 can prevent the shaft 112 from rotating along with the drum 102 as the drum 102 rotates, and thereby keep the shaft 112 in a consistent orientation relative to the ground. In another embodiment, the shaft 112 can be held in a static position relative to the compaction machine 100 by operation of motor 114 while the drum 102 rotates around the shaft 112. In this embodiment, the electromagnet(s) 116 can always face the same direction with respect to the ground regardless of the drum's 102 rotation.

Figure 3:
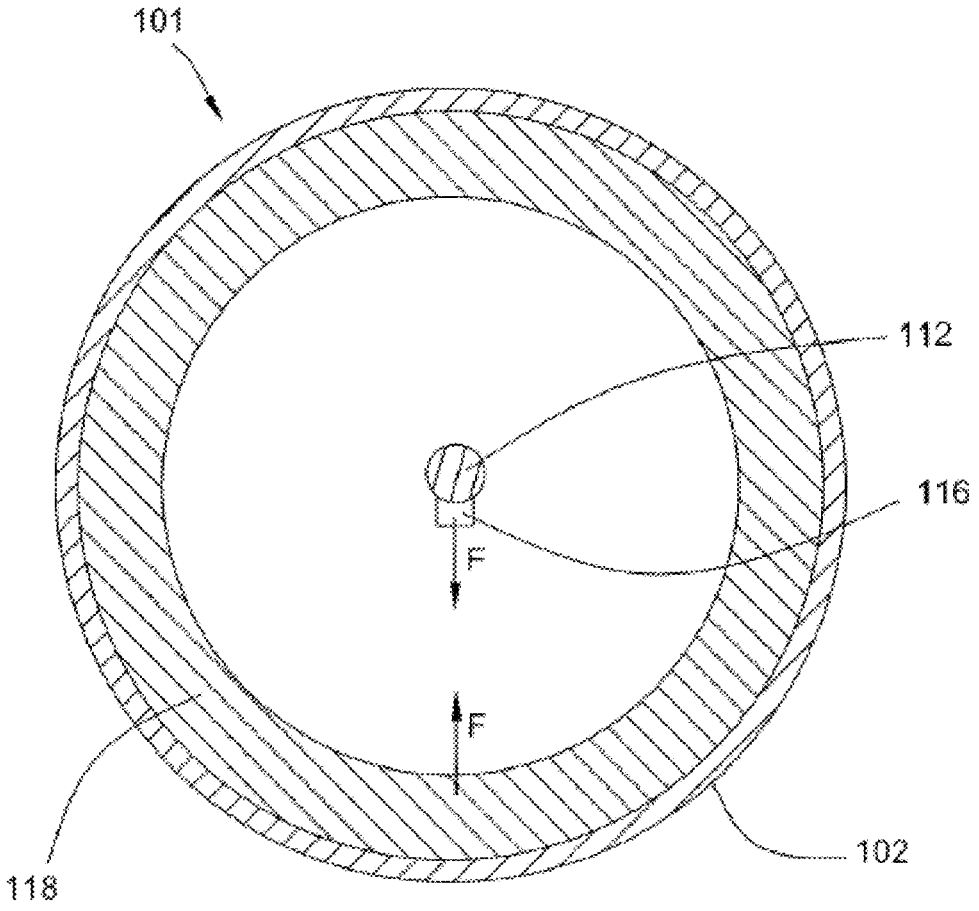
FIG. 3 is a side schematic sectional view of the drum of FIG. 2.

When electric current is provided through the electromagnet 116, the electromagnet 116 can activate and produce a magnetic field that attracts ferrous materials such as iron, steel, and alloys thereof. As shown in the embodiment illustrated in FIG. 3, which is a cross section through the drum 102, the drum 102 can have a base 118, which may be cylindrical and made of metal, that extends axially around the entire inner circumference of the drum 102. When the electromagnet 116 is activated, an attractive magnetic force, F, can be created between the electromagnet 116 and the base 118, which attracts a portion of the base 118 towards the shaft 112 on the drum's 102 longitudinal axis. Alternatively, or in conjunction, the drum 102 itself can be metallic and the electromagnet 116 can create an attractive magnetic force between portions of the drum 102 and the shaft 112 upon the electromagnet's 116 activation.

The magnetic pulling force F created by the activated electromagnet 116 can cause the base 118 and a portion of the drum 102 nearest the electromagnet 116 (or just a portion of the drum 102 nearest the electromagnet 116 in the case of the drum being metallic) to tend to move or deform slightly toward the shaft 112. When electric current to the electromagnet 116 ceases to flow, the electromagnet 116 ceases to produce a magnetic field and stops pulling the base 118 toward the shaft 112. The drum 102 and the base 118 then return to their original, neutral force position with respect to the shaft 112. Activating and deactivating the electromagnet 116 in succession (e.g., rapid succession) can cause the drum 102 to vibrate as the drum 102 or base 118 moves towards and away from the electromagnet 116 as the electromagnet 116 is turned on and off.

Alternatively, the shaft 112 can be mounted using a resilient bushing 126 (see FIG. 2). The bushing 126 can be made from rubber or some other resilient, but flexible material. When the electromagnet's 116 magnetic field is activated, the attractive force between the electromagnet 116 mounted on the shaft 112 and the drum 102 can cause the shaft 112 to press against the bushing 126. The bushing 126 can flex, allowing the shaft 112 to move slightly off of the drum's 102 longitudinal direction in the direction of the magnetic force. The flexing distance provided by the bushing 126 can allow displacement of the shaft 112 relative to the drum 102, which can depend upon the strength of the magnetic field created by the electromagnet 116. When the electromagnet 116 deactivates, the bushing 126 can force the shaft 112 back to its original position on the longitudinal access of the drum 102. When the electromagnet 116 is selectively activated and deactivated repeatedly in succession (e.g., rapidly), the force of the shaft 112 moving towards the drum 102 when the electromagnet 116 activates, and back into its original position in the bushing 126 when the electromagnet deactivates, can cause the drum 102 to vibrate.

Other embodiments can have multiple sensors, such as multiple electromagnets 116, attached to the shaft 112 (e.g., around the circumference of the shaft 112). For example, some embodiments can have multiple electromagnets 116 attached to one side of the shaft 112, while others can have one or multiple electromagnets 116 attached to opposing sides of the shaft 112.

Figure 4:
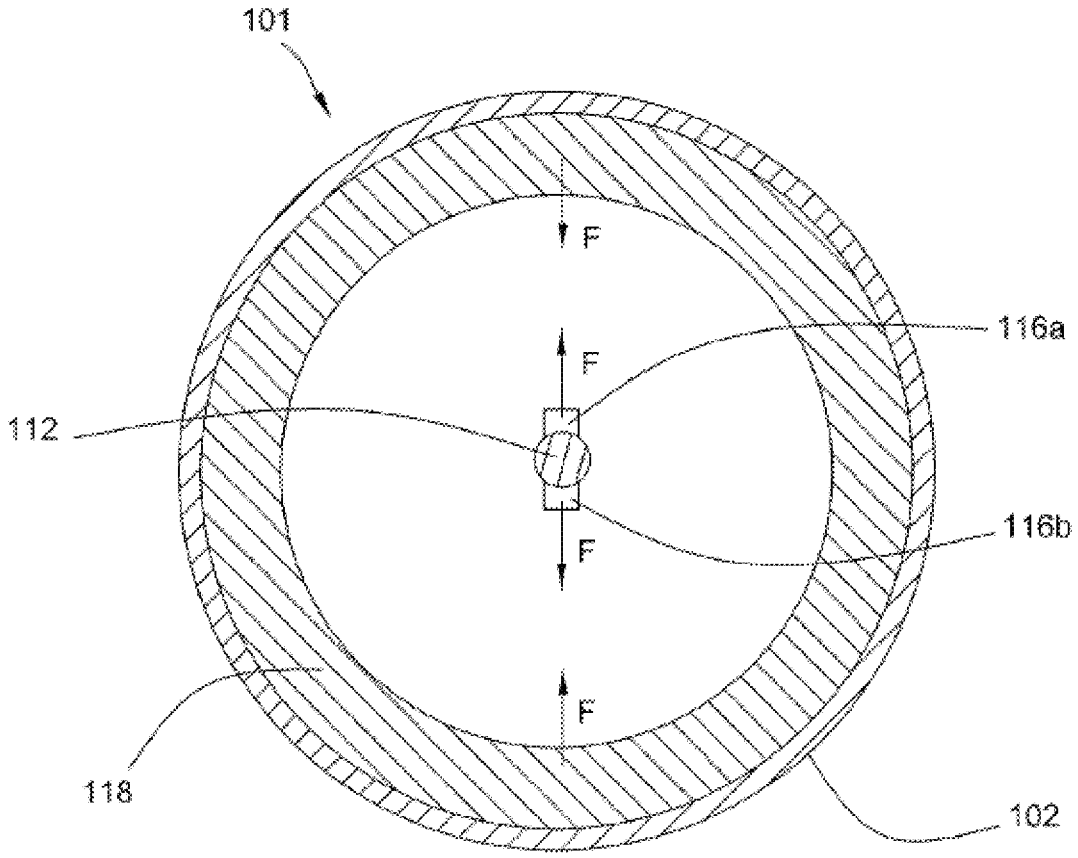
FIG. 4 is a side schematic sectional view of a further embodiment of a drum of the vibratory compactor of FIG. 2.

FIG. 4, for instance, illustrates an embodiment having electromagnets 116*a*, 116*b* on opposing sides of the shaft 112, particularly top and bottom sides of the shaft 112. The two electromagnets 116*a*, 116*b* can work in conjunction with one another when vibration for the drum 102 is activated. Each of the electromagnets 116*a*, 116*b* can be activated in succession. For example, when the operator activates vibration for the drum 102, current can run first through electromagnet 116*a*, then through electromagnet 116*b*. The current then can continue to be switched from electromagnet 116*a* to electromagnet 116*b* for as long as drum 102 vibration is active. When electromagnet 116*a* activates due to current flow, the activation can create a magnetic force that pulls the top of the drum 102 downward toward the shaft 112 or pulls the shaft 112 upward towards the drum 102. Subsequently, when electromagnet 116*b* is activated, the activation can pull the bottom of the drum 102 upward towards the shaft 112 or pull the shaft 112 downward toward the drum 102.

When the two electromagnets 116*a*, 116*b* are activated in conjunction, the drum 102 can vibrate with a larger amplitude than when only one electromagnet 116 is used (or activated) because magnetic forces pull on both the top and bottom of the drum 102, or the top and bottom of the shaft 112. With only one electromagnet 116, such as in FIG. 3, the shaft 112 can move toward the drum 102 against the resilient bushing 126 in response to the magnetic force F and then move back to its original position in response to the resiliency of the bushing 126. With multiple electromagnets 116*a*, 116*b*, such as in FIG. 4, the shaft 112 can move downward against the resilient bushing 126 toward the drum 102 when electromagnet 116*b* is activated, then can move upward toward the drum 102 when electromagnet 116*b* is deactivated and electromagnet 116*a* is activated. When the shaft 112 moves upward and downward against the resilient bushing 126 in succession (e.g., rapid succession), the drum 102 can vibrate with about twice the amplitude as when only one electromagnet 116 is used (assuming same size or capacity of electromagnets). Additionally, multiple electromagnets 116*a*, 116*b* can allow the drum 102 to vibrate at a higher frequency relative to vibration induced by a single magnet (assuming same size or capacity of electromagnets). For example, when used in conjunction, two electromagnets 116*a*, 116*b* can apply an electromagnetic force to the drum 102 at double the frequency possible as compared to when only one electromagnet 116 is used, by alternating the activation of the electromagnets 116*a*, 116*b*.

Figure 5:
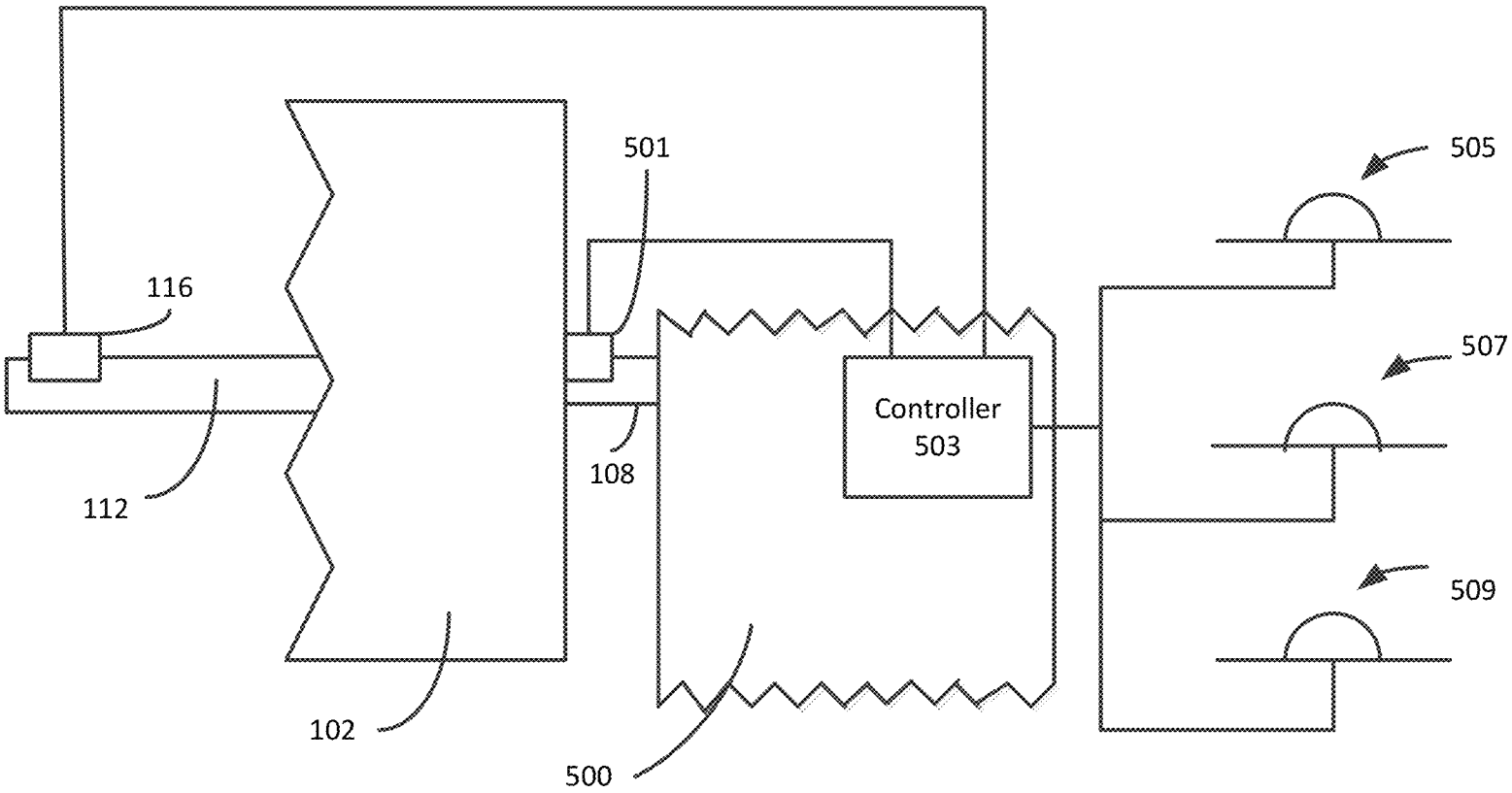
FIG. 5 is a block diagram of a control system for compactor machines in accordance with an exemplary aspect of the disclosure.

Controls 106 in the compaction machine's 100 operator area 104 can allow an operator to manually switch the drum 102 between a non-vibrating and vibrating state using an activation control 509, such as shown diagrammatically in FIG. 5. As mentioned above, a drum 102 can be connected to the compaction machine 100 by an axle 108. For purposes of simplicity, only a portion 500 of the compaction machine is shown in the drawing. Further regarding FIG. 5, when the operator manually switches the activation control 509 from the non-vibrating position to the vibrating position, a controller 503 can receive a corresponding signal and provide a signal to the electromagnet 116 (or electromagnets 116*a*, 116*b*) in pulses that cause the electromagnet 116 to activate and deactivate in succession, resulting in vibration of drum 102. The amount of current provided through the electromagnet 116 can be modulated, for instance, by any appropriate means, such as by use of a Pulse Width Modulated (PWM) signal provided to the electromagnet 116 from the controller 503. When the electromagnet 116 is active, a PWM signal from the controller 503 can control current to the electromagnet, which, in turn, can produce a magnetic force F. Optionally, the electric current flowing to the electromagnet 116 can be represented by a square wave.

The controls 106 can allow the operator to manually set the amplitude of the drum's 102 vibration using the amplitude control 507. As illustrated schematically in FIG. 5, the amplitude control 507 can be in communication with the controller 503, which receives the value of the amplitude control and provides a corresponding control signal to the electromagnet 116. The amplitude control 507 can adjust the duty cycle of the PWM signal, which can affect the strength of the magnetic force F. Additionally or alternatively, the amplitude of the signal may be adjusted. The duty cycle can be set at substantially any value between 0% and 100%. The stronger the force F pulling on the drum 102, the more the drum 102 or the shaft 112 can be displaced by the force, and the higher the amplitude of the drum vibration can become. Because the amplitude of the drum 102 vibration can vary based on the duty cycle of the PWM signal provided through the electromagnet 116, the vibratory compactor assembly 101 can vibrate the drum 102 at an infinite number of amplitudes. Of course, certain amplitudes for vibration may be preset or predetermined according to one or a plurality of different groups of vibration amplitude. Such sets or groups of vibration amplitude can be selected using the amplitude control 507.

The operator can also use the controls 106 to set a value for the drum 102 vibration's frequency using the frequency control 505. The frequency control 505 can determine the intervals in which the PWM signal flows to the electromagnet 116. The frequency control 505 can also be in communication with the controller 503. Generally, the higher the vibration frequency the operator chooses, the less time passes between each activation time period of the electromagnet 116 (or magnets 116*a*, 116*b*).

The activation time period can represent moments in time when a PWM signal is provided to the electromagnet 116 and, thus, magnetic forces are pulling the drum 102 toward the shaft 112 or pulling the shaft toward the drum 102. Between each activation time period, the current can be at zero or near zero, which can result in negligible or no magnetic force applied between the drum 102 and the shaft 112. The amplitude of the drum 102 vibration can be directly related to the duty cycle of the PWM signal applied to the electromagnet 116.

A compaction measurement sensor 501 can be provided to determine the position and/or rate of drum 102 rotation and send this information to the controller 503. The controller 503 can use the position and/or rotation rate information to determine the required shaft 112 rotation required to maintain a shaft position in which the electromagnet 116 is oriented downward, for instance. It should be noted, that the electromagnet 116 can be oriented downward so that the magnetic force attracts a portion of the metal base 118 towards the shaft 112 in a direction towards the surface being compacted. The controller 503 can then activate the motor 114 as appropriate to maintain shaft 102 orientation. In one embodiment, the rotation rate of the shaft 112 can be substantially the same as that of the drum 102, but in the opposite direction.

FIG. 2 shows the interior of drum 102 in vibratory compactor assembly 101 that includes one or more electromagnets 116 as a mechanism to induce a vibration force. Another mechanism to induce a vibration force is a vibratory compactor assembly that includes an outer eccentric weight, an inner eccentric weight, and a key shaft. The amplitude of the vibration force may be controlled by bringing the inner eccentric weight in phase or out of phase with the outer eccentric weight. Intermediate vibration amplitudes less than the maximum or greater than the minimum may be obtained by setting the phase angle of the inner eccentric weight to the outer eccentric weight between 0 and 180 degrees. The frequency of vibration force may be controlled by increasing or decreasing the speed of a vibratory motor.

Another type of compactor is a pneumatic compactor. Pneumatic compaction machines are often used to compact material, e.g., soil, asphalt, and the like, to a desired density. This process usually requires several passes over the material to achieve the desired compaction. The performance of the pneumatic compaction machine varies as the inflation pressure of the tires changes. For example, low inflation pressure improves the traction and mobility of the compactor on soft ground, and high inflation pressure results in more efficient compaction performance on firm surfaces.

Figure 6:
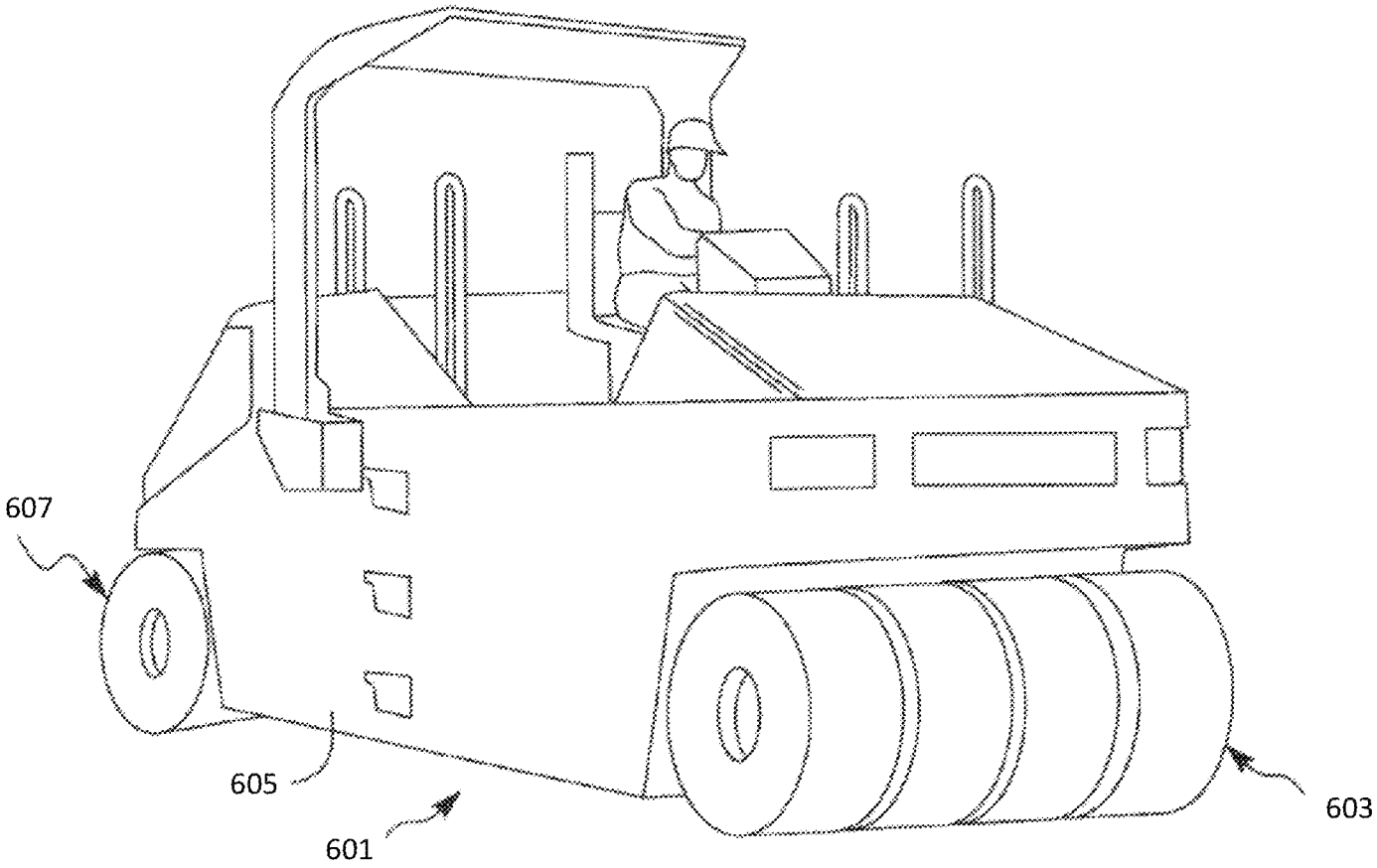
FIG. 6 is an outline view of an example of a pneumatic compactor machine in accordance with an exemplary aspect of the disclosure.

FIG. 6 is an outline view of an example of a pneumatic compaction machine 601 in accordance with an exemplary aspect of the disclosure. The pneumatic compaction machine 601 may have a set of compacting wheels containing pneumatically inflated front suspension tires 603. In some embodiments, the pneumatic compaction machine 601 may also have a set of rear suspension tires 607 or multiple sets of suspension tires. The front suspension tires 603 and the rear suspension tires 607 may be rotatably mounted on a main frame 605 of the pneumatic compaction machine 601. Hence, a vibratory compactor assembly and corresponding vibratory control as described above for compaction machine 100 can be implemented in pneumatic compaction machines, such as pneumatic compaction machine 601, though in the context of the axle of the wheels of the front suspension tires 603 and/or the axle of the wheels of the rear suspension tires 607. Likewise, a vibratory compactor assembly and corresponding vibratory control as described above for compaction machine 100 can be implemented in hybrid compaction machines that combine the drum of a vibratory compaction machine with pneumatic tires of a pneumatic compaction machine. Hence, various disclosed embodiments of a control system for a compaction machine may apply to a vibratory compaction machine, a pneumatic compaction machine, or a combination vibratory and pneumatic compaction machine.

Figure 7:
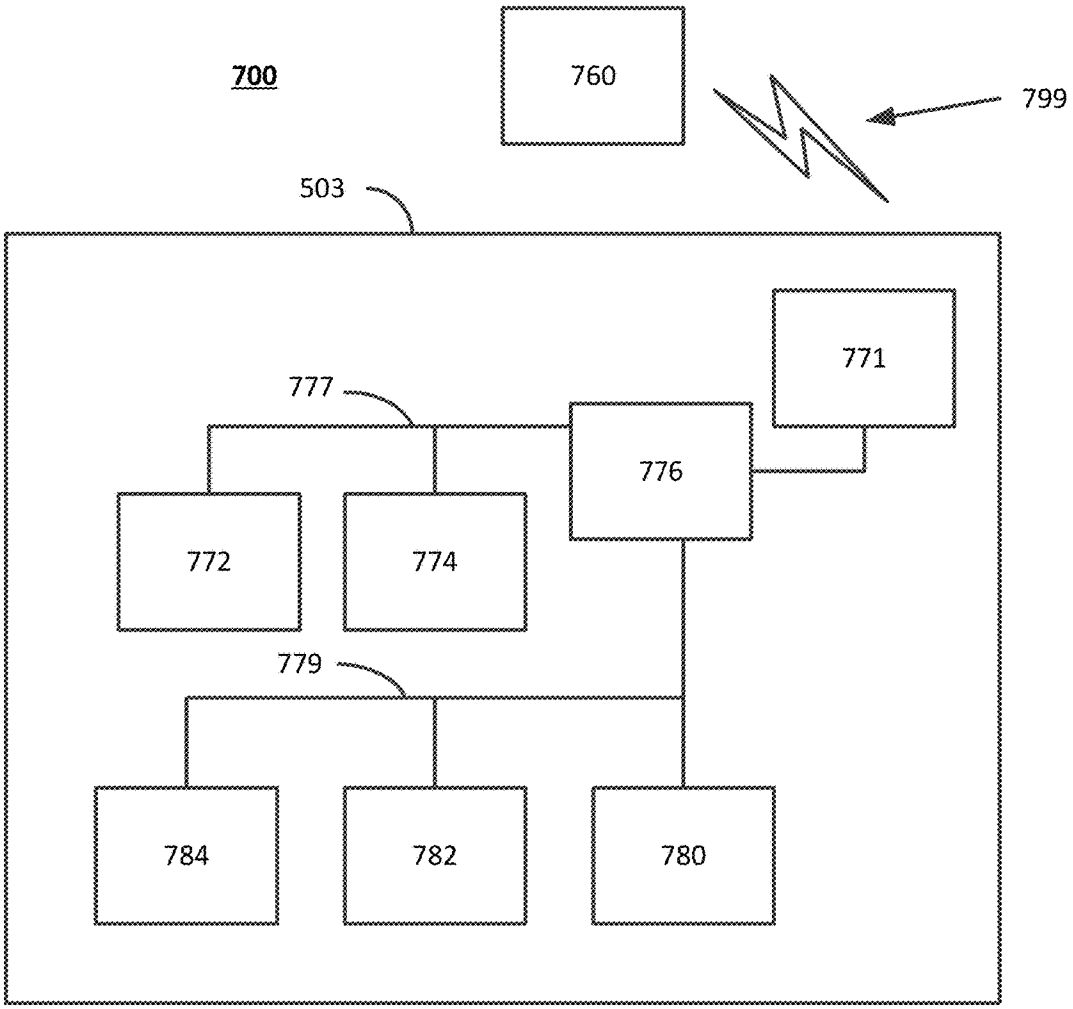
FIG. 7 illustrates an exemplary remote control system in which features and principles consistent with certain disclosed embodiments can be implemented.

FIG. 7 illustrates an exemplary remote control system 700 in which features and principles consistent with certain disclosed embodiments may be implemented. As shown in FIG. 7, a remote control system 700 may include an off-board system 760, and the controller 503. In some embodiments, the off-board system 760 may communicate with the controller 503 by way of a secure communications link 799. The secure communications link 799 may be established using public key infrastructure (PM) and may perform secure communication using public key cryptography. The controller 503 can include a communication module 771, an interface control system 776, and on-board modules 772, 774, 780, 782, 784, respectively connected to primary and secondary on-board data links 777 and 779. Although interface control system 776 is shown as a separate entity, some embodiments may allow interface control system 776 to be included as a functional component of one or more of on-board modules 772 and 774. Further, although only a specific number of on-board control modules are shown, controller 503 may include any number of such modules. Each on-board module 772, 774, 780, 782, 784 may include an Electronic Control Unit (ECU), or may be connected to a central ECU of the compaction machine 100. In the case of communication over a secure communications link 799, the communication module 771 may keep a private key used for decrypting encrypted messages received from the off-board system 760. The communication module 771 and/or on-board modules 772, 774, 780, 782, 784 may also obtain a public key for use in encrypting messages and/or data when transmitted between modules or to the off-board system 760. For purposes of this disclosure, the communication module 771 and on-board modules 772, 774, 780, 782, 784 are also referred to as a secure access.

In some embodiments, the remote control system 700 is configured to operate the vibratory compaction machine 100, or another configuration of compaction machine, such as a combination compaction machine, based on multiple operating parameters, such as basic operating parameters and/or specific operating parameters. The basic operating parameters may include, for example, compaction in a limited number of vibrational amplitudes, and may be provided as a default for the control system. The specific operational modes may include specific operating parameters, such as compaction in a wider number of vibrational amplitudes, multiple frequencies, vibration autonomy, and/or compaction measurement by a sensor. The remote control system 700 may provide the OEM or a dealer authorized by the OEM with an ability to set specific operating parameters required to perform a specific job. In some embodiments, the contractor may pay additional fees (e.g., via a subscription) for specific operating parameters. The OEM or dealer may disable the specific operating parameters, for instance, when not required or when a certain time period has expired (e.g., after a job, end of a subscription, etc.).

Figure 8:
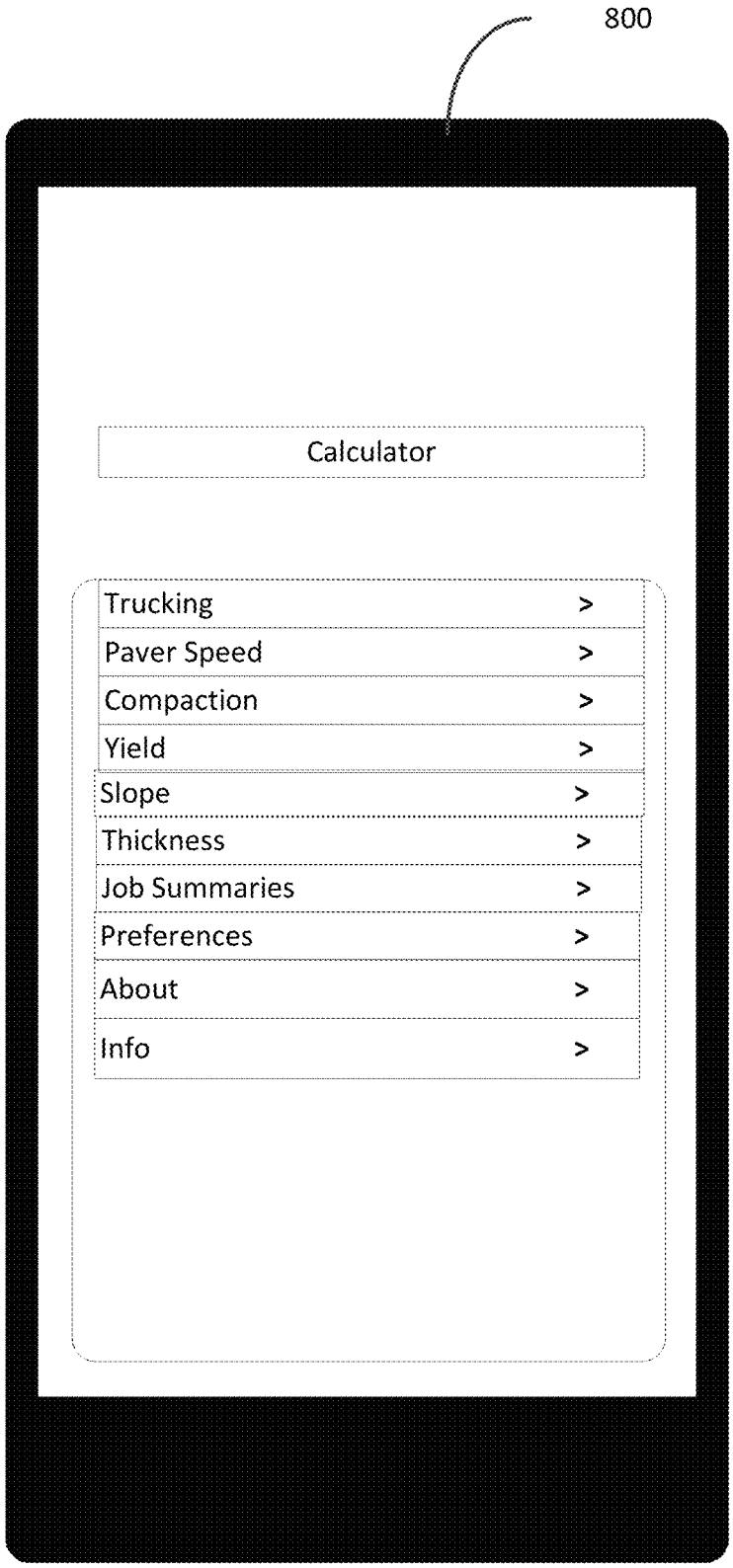
FIG. 8 is a user interface of a paving calculator in accordance with the disclosure.

In some embodiments, a paving calculator may be used to estimate needed specific operating parameters before starting a job. FIG. 8 is an example user interface for a paving calculator. The Paving Production Calculator 800 is a tool for paving professionals to plan their paving jobs by helping to estimate trucking needs, paving speeds, compaction and other factors. The Paving Production Calculator 800 can help optimize the job site, reducing inefficiency and contributing to smoothness. The Paving Production Calculator 800 may be used by entering information about a job site, such as length, width, thickness (depth), type of rock or other material, such as asphalt or dirt. The Paving Production Calculator 800 may be a mobile application installed in a mobile device or may be an application specific electronic device.

Once a paving job is planned, a compaction machine, such as compaction machine 100 or a combination compaction machine, may be obtained for desired parameters at estimated periods of time. The desired parameters can include vibration amplitude capability, vibration frequency capability, and/or compaction measurement sensor configuration. The periods of time may be calendar-based (e.g., number of days, months, years) or may be compactor machine-hour-based. Compaction machine-hour-based may be based on the engine running time, or based on the vibratory system running time.

Figure 9:
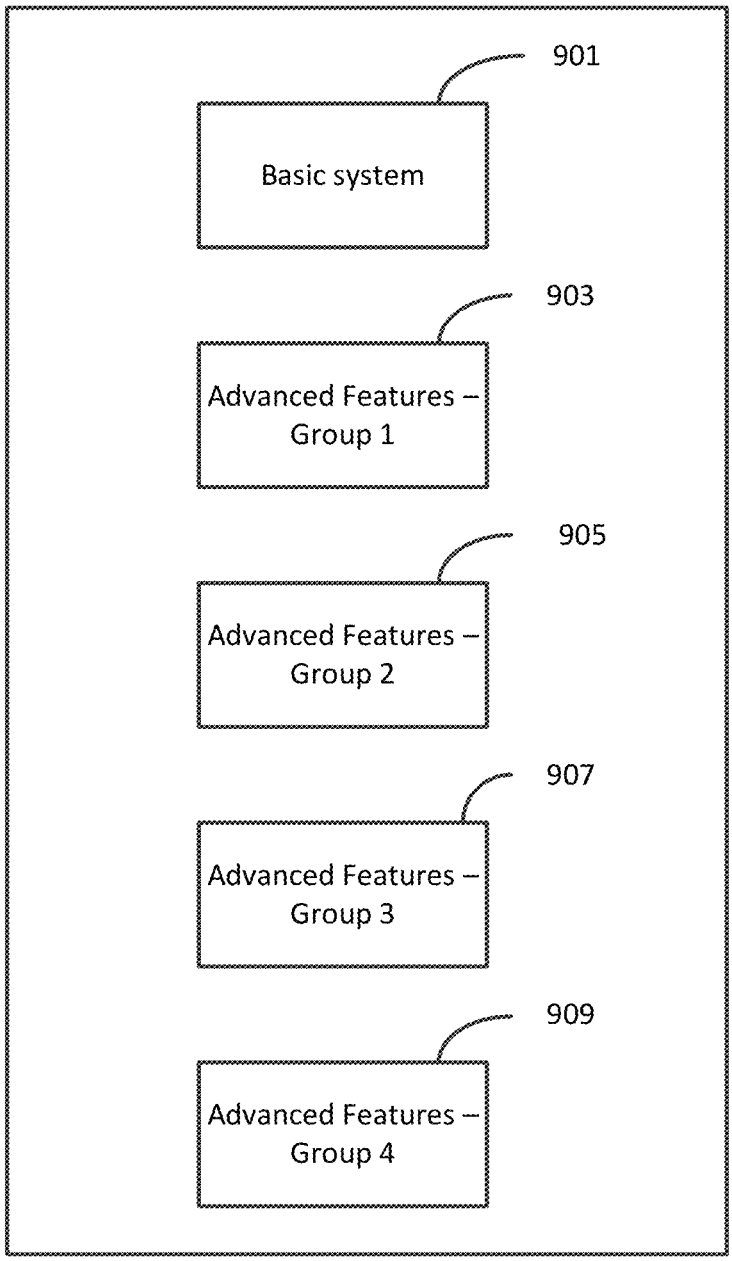
FIG. 9 is a block diagram of selectable features in accordance with an exemplary aspect of the disclosure.

FIG. 9 is a block diagram of selectable vibratory features in accordance with an exemplary aspect of the disclosure. In some embodiments, groups of vibratory features can be set up by the original equipment manufacturer (OEM) or a third party, e.g., dealer, authorized by the OEM. The vibratory features can be selectable by way of a user having privileged access to the controller 503 of the particular compaction machine, such as compaction machine 100. Upon entering authentication credentials, an authorized user may be granted access to settings of the controller 503. The settings may include software switches for switching on or off specific groups of features. In other embodiments, the settings may include seamless shift or advanced display interfaces. In a seamless shift arrangement, the vibratory features may be unlocked with the entry of a key code or remotely via a key code, or by way of a license agreement. Generally, the selectable features may be grouped as a set of basis or standard features, for a basic system 901, and sets of advanced features for advanced systems 903, 905, 907, and 909.

Figure 10:
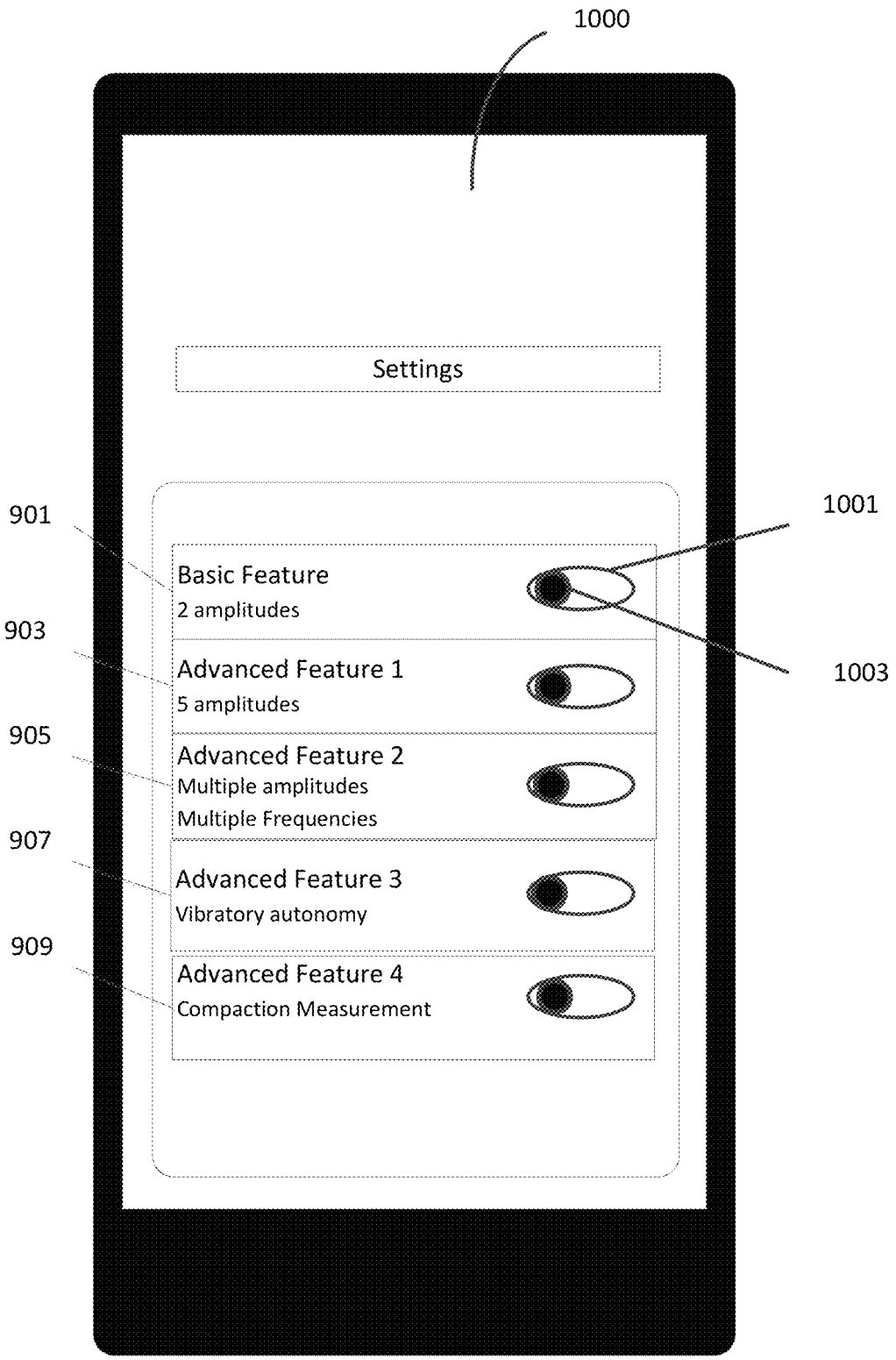
FIG. 10 is a user interface for setting selectable features in a remote setting device in accordance with an exemplary aspect of the disclosure.

FIG. 10 is a user interface for setting selectable features in a remote setting device in accordance with an exemplary aspect of the disclosure. A user interface 1000 may be configured as a list of basic feature 901 and advanced features 903 to 909, each having an on-off switch 1001. Features may be switched from off to on by sliding a button 1003 from left to right.

Basic system operating parameters 901 may include a minimum number of vibration amplitudes (e.g., two amplitude values) for individual selection by an operator. Advanced system operating parameters (features) may be added (e.g., via a subscription) and may include Group 1 903—5 amplitudes for individual selection by the operator, Group 2 905—multiple vibrational amplitudes and multiple vibration frequencies for individual selection by the operator, Group 3 907—vibration autonomy, and/or Group 4 909—compaction measurement. In some embodiments, vibration frequency may include fast/slow frequencies.

Figure 11:
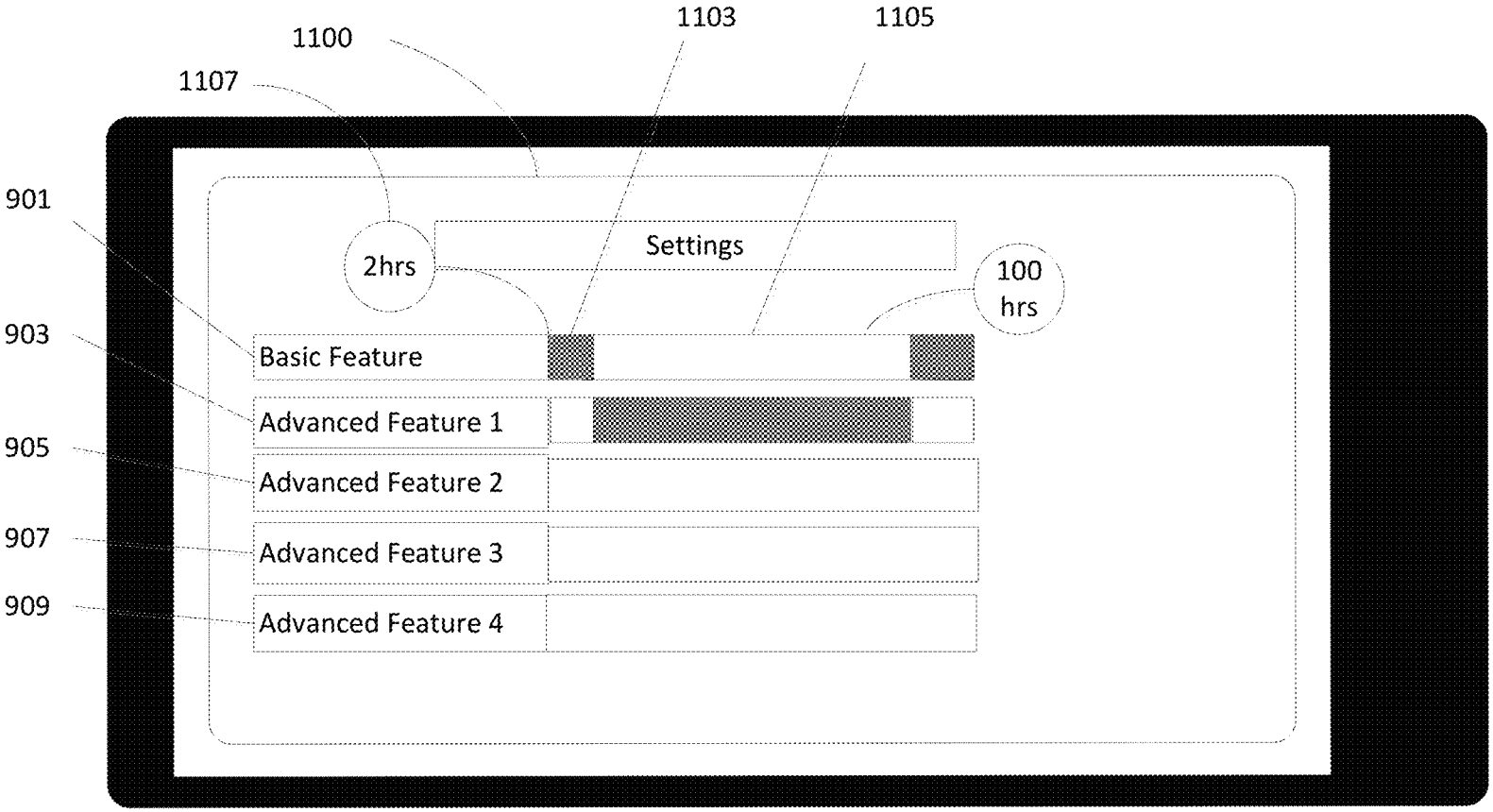
FIG. 11 is a user interface for scheduling selectable features in a remote setting device in accordance with an exemplary aspect of the disclosure.

FIG. 11 is a user interface for scheduling switchable features in a remote setting device in accordance with an exemplary aspect of the disclosure. The user interface 1100 may be used to set a time duration of one or more of the advanced features 903 to 909. The time duration may be compactor machine hours, vibration system operating hours, or a calendar period of time. The time duration may be adjusted by moving a bar. By default, all advanced features can be OFF. A white bar 1105 can represent an OFF period. Only one advanced feature may be operational (ON) at any period of time. A time duration of an advanced feature 803 may be adjusted by dragging a bar at the boundary of a white bar 1105 to adjust the time duration of the OFF time period and add an ON time period (represented by a solid bar 1103). As ON/OFF time periods are adjusted, an indication 1107 of the time duration of the ON time period 1103 may be displayed.

Figure 12:
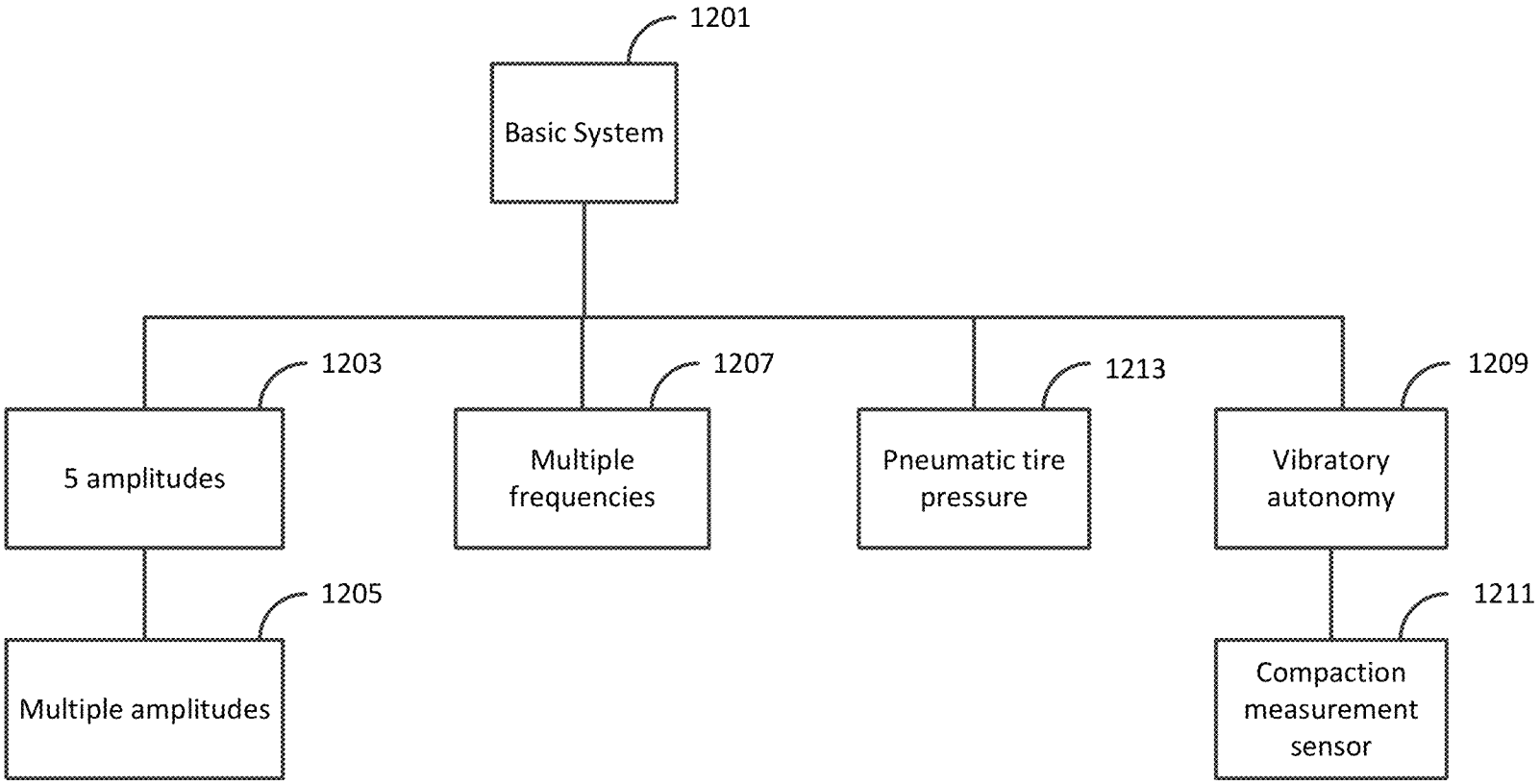
FIG. 12 is a diagram of a hierarchy of selectable feature levels in accordance with an exemplary aspect of the disclosure.

FIG. 12 is a diagram of a hierarchy of selectable feature levels in accordance with an exemplary aspect of the disclosure. In some embodiments, selectable features may be organized as hierarchical levels. The lowest level may be a basic level 1201 with a minimum number of features, such as providing the option of two vibration amplitudes that are selectable by an operator. A next level 1203 may have additional features, such as three additional amplitudes for a total of five amplitudes (in this example the vibration amplitudes of the next level 1203 overlap with the vibration amplitudes of the basic level 1201). A next level 1205 may have still additional features, such as a set of more than five amplitudes, which may or may not overlap the basic level 1201 and/or the next level 1203. Another level may add vibration frequencies 1207 to the basic level 1201. In another level 1209, the operating parameters may be set to full vibration autonomy where vibration amplitude and vibration frequency may be adjusted automatically according to a predetermined schedule. In a level after the level for vibration autonomy, a compaction measurement sensor 1211 may be added in order to provide feedback to aid in the adjustment to vibration amplitude and/or vibration frequency. The compaction measurement sensor 1211 may include a density sensor that can measure density of the material that is being compacted. In another level, the operating parameters may include a pneumatic tire pressure 1213 for pneumatic rear tires.

Switching between levels may be on a cost basis, with feature levels or groups of feature levels that may be priced as packages. The basic system 901, 1201 may be available to all customers at the lowest price. When operating a compaction machine according to embodiments of the disclosed subject matter, such as compaction machine 100, a pneumatic compaction machine, or a combination compaction machine, on a job that requires different operating parameters, the OEM or a dealer authorized by the OEM may enable those parameters for an additional fee. The specific operating parameters may include any of Groups 1 to 4 in FIG. 9, or levels 1203 to 1211 in FIG. 12.

INDUSTRIAL APPLICABILITY

Asphalt paving contractors build a variety of roads and other paved surfaces that require different operating parameters. To fulfill this need, multiple options from which to pick from can be offered to the contractors. Combinations of multiple vibration amplitudes and multiple vibration frequencies from which to pick may also be desirable. In this context, each compactor machine option may be limited to specific job sites. Offering additional compactor machine options to pick from can add complexity to machine design and assembly. Purchasing compactor machines for each specific job site leads to excessive costs. Leasing compactor machines may be limited to types of compactor machines that are available at a leasing agency.

A solution of the present disclosure is an asphalt paving compactor that can implement multiple operating parameters, where a contractor can be allotted an initial subset of operating parameters, and can upgrade to additional (e.g., advanced) parameters for specific job sites for limited time periods. When expired, the parameters can be reset to the initial subset of operating parameters.

The specific operating parameters may include vibratory system amplitude, frequency, and/or use of a compaction measurement sensor. The solution can minimize cost while providing vibration at appropriate amplitudes and frequencies when desired. The solution can provide simplicity, in that choices of amplitude and/or frequency combinations may be limited to only those needed for each job. Unnecessary amplitudes and frequencies may be disabled.

For example, a contractor can obtain a job that requires an advanced parameter. The contractor can pay for the required parameter in order to obtain a feature or features needed to accomplish the job. At a later time, the contractor takes a job that does not require the advanced parameter. The features associated with the advanced parameter may be disabled. Payment for the advanced parameter can be incurred only for the time that the advanced parameter is needed. The advanced parameter can be disabled as a selection option when the advanced parameter is not needed or when a time period associated with the payment expires.

In another example, a dealer leases a compactor machine to a contractor. The dealer configures parameters of the compactor machine to meet required features required to accomplish a job. The dealer may lease the same compactor machine to another contractor, where the compactor machine is configured with a different set of parameters. The dealer can offer the same compactor machine to different contractors at different costs depending on needs without having to purchase several different compactor machines for its inventory.

It is one object of the present disclosure to describe a system and a method that controls (e.g., via a controller) a vibratory compactor that can be set for particular groups of various combinations of vibration frequencies and/or amplitudes. It is a further object to describe a controller that is switchable by the OEM, for instance, between the groups of vibration frequencies and amplitudes for compactor machines of various sizes based on predetermined conditions (e.g., payment, job requirements, etc.).

It is a further object to describe a method of managing asphalt compactor machine features that allows a subscriber to purchase a compactor machine with only the basic parameters enabled (for example 2 amplitudes). This can limit the subscriber the option to select only between two features on the compactor. However, when the subscriber has a job that requires additional parameters (e.g., five amplitudes) in order to meet the specifications required on the job, the subscriber may contact the machine dealer and request the additional features be added to the compactor machine for a specific duration. Upon completion of the specific duration, the compactor machine may be switched back to the basic features. The subscriber is thus able to choose only the features as they are needed without having to pay for features that are not needed and simplifying choice of features during a particular job.

Figure 13B:
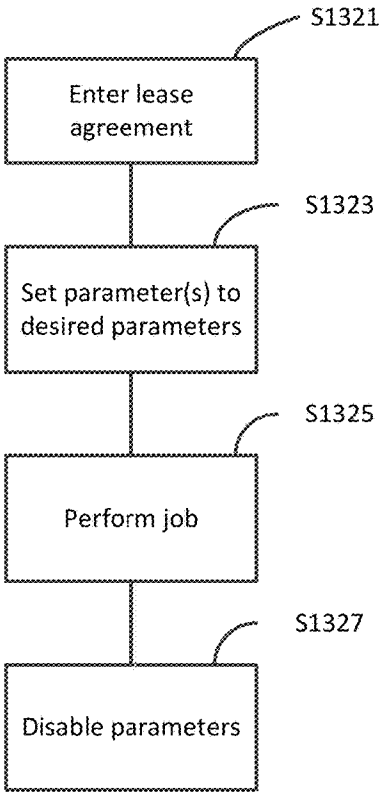
FIGS. 13A and 13B are flowcharts of methods or operations in accordance with exemplary aspects of the disclosure.
Figure 13A:
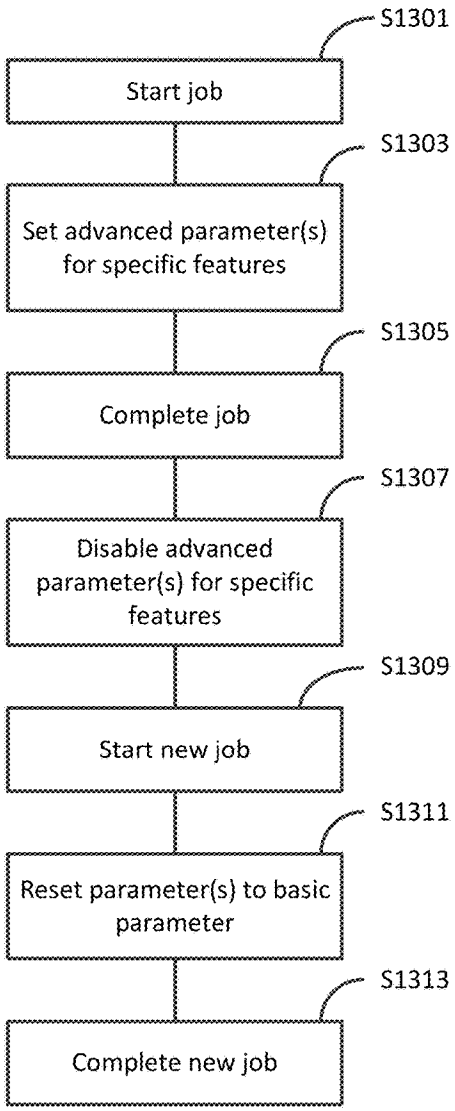

FIGS. 13A and 13B are flowcharts for operation of a compaction machine, such as compaction machine 100, in accordance with an exemplary aspect of the disclosure. In FIG. 13A, a contractor, for instance, can set out to build a road. The contractor can buy or lease a compactor machine with the basic features enabled (e.g., 2 amplitudes). This can allow the subscriber to only select between 2 parameters on the compaction machine 100. As an example, the $1^{st}$ parameter may be 0.3 mm of amplitude and the $2^{nd}$ parameter may be 0.8 mm of amplitude.

In S1301, the contractor may begin working on a job that requires additional parameters (5 amplitudes) in order to meet the specifications required for the job. In S1303, the contractor may contact the machine dealer and request additional parameters to be added to the machine for a predetermined duration, for example 1 month duration. A switch may be made to the compactor machine so that the contractor now has 5 parameters on the machine to choose from: $1^{st}$ parameter—0.2 mm, $2^{nd}$ parameter—0.3 mm, $3^{rd}$ parameter—0.5 mm, $4^{th}$ parameter—0.8 mm, $5^{th}$ parameter—1.0 mm.

As described above, switching to include additional parameters to be added to the machine may be performed in various ways. In some embodiments, switching may be accomplished using software switches for switching on or off specific groups of features. In other embodiments, switching may include a seamless shift or advanced display interfaces. In a seamless shift arrangement, the vibratory features may be unlocked with the entry of a key code or remotely via a key code, or by way of a license agreement. In some embodiments, the switching uses the secure communications link 799, also referred to as a secure connection. In particular, a software upgrade or a key code may be transmitted from the off-board system 760 to the communication module 771 using the secure connection.

Upon completion of the 1 month duration in S1305, in S1307 a switch control signal can be sent to the compaction machine 100, a pneumatic compaction machine, or a combination compaction machine to disable the additional parameters so that upon starting a new job S1309, in S1311, the parameters are reset back to only 2 parameters to choose from again until S1313 completion of the new job.

In FIG. 13B, in S1321, a dealer can lease the compaction machine 100, pneumatic compaction machine, or combination compaction machine to a contractor. In S1323, the machine parameters can be configured to match what the contractor requires. In S1325, the contractor performs the job. In S1327, the parameters can be disabled by the dealer upon completion of the job or after expiration of a predetermined amount of time.

Figure 14:
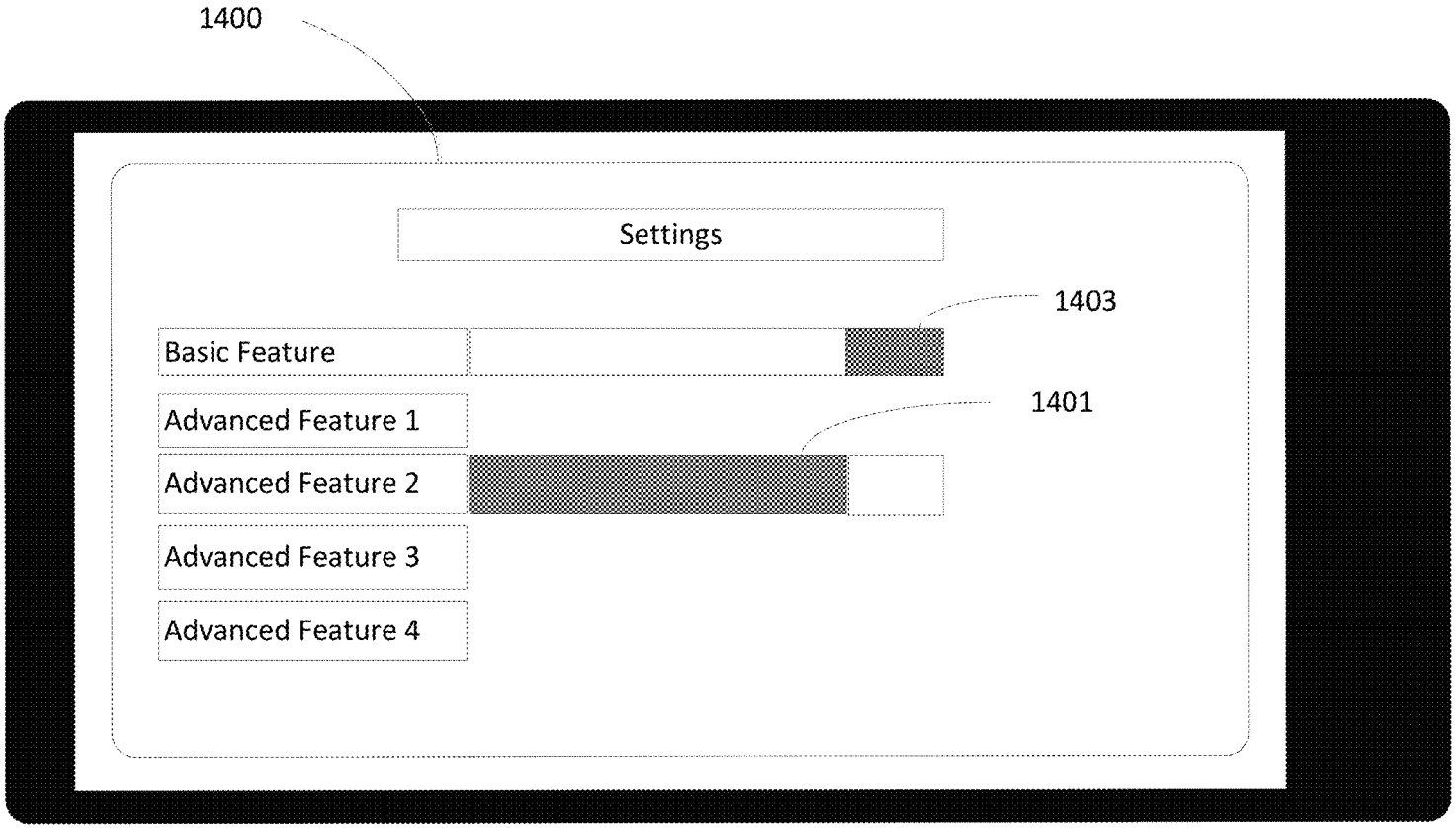
FIG. 14 is a user interface for scheduling selectable features in a remote setting device in accordance with an exemplary aspect of the disclosure.

FIG. 14 is a user interface 1400 to set an operation of the compaction machine 100, pneumatic compaction machine, or combination compaction machine. In the project, the contractor may pay for an advanced feature to begin a project. The dealer can set advanced feature 2 for a certain time duration 1401. The time duration may be compactor machine hours, vibration system operating hours, or a calendar period of time. After the certain time duration, the contractor begins work on a road that does not require the advanced feature. In such case, the advanced feature can be disabled and work is performed to complete the project with the basic feature 1403.

Figure 15:
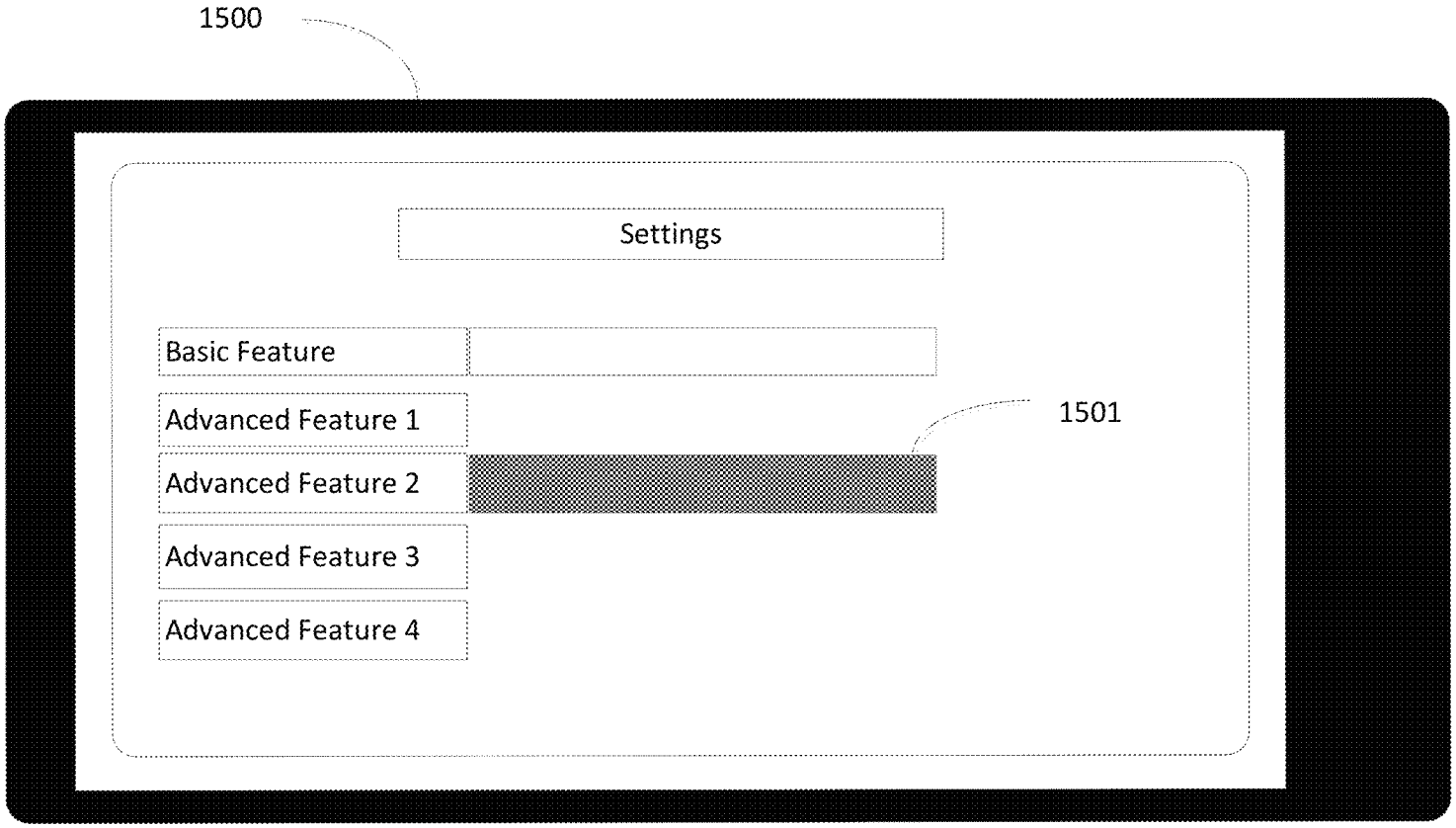
FIG. 15 is a user interface for scheduling selectable features in a remote setting device in accordance with an exemplary aspect of the disclosure.

FIG. 15 is a user interface that is set for the operation of FIG. 13B. A dealer can lease the compaction machine 100, pneumatic compaction machine, or a combination compaction machine to a contractor. The dealer can configure machine parameters, Advanced Feature 2, to match the time duration 1501 that the contractor requires. The contractor performs the job in the required time duration.

Figure 16:
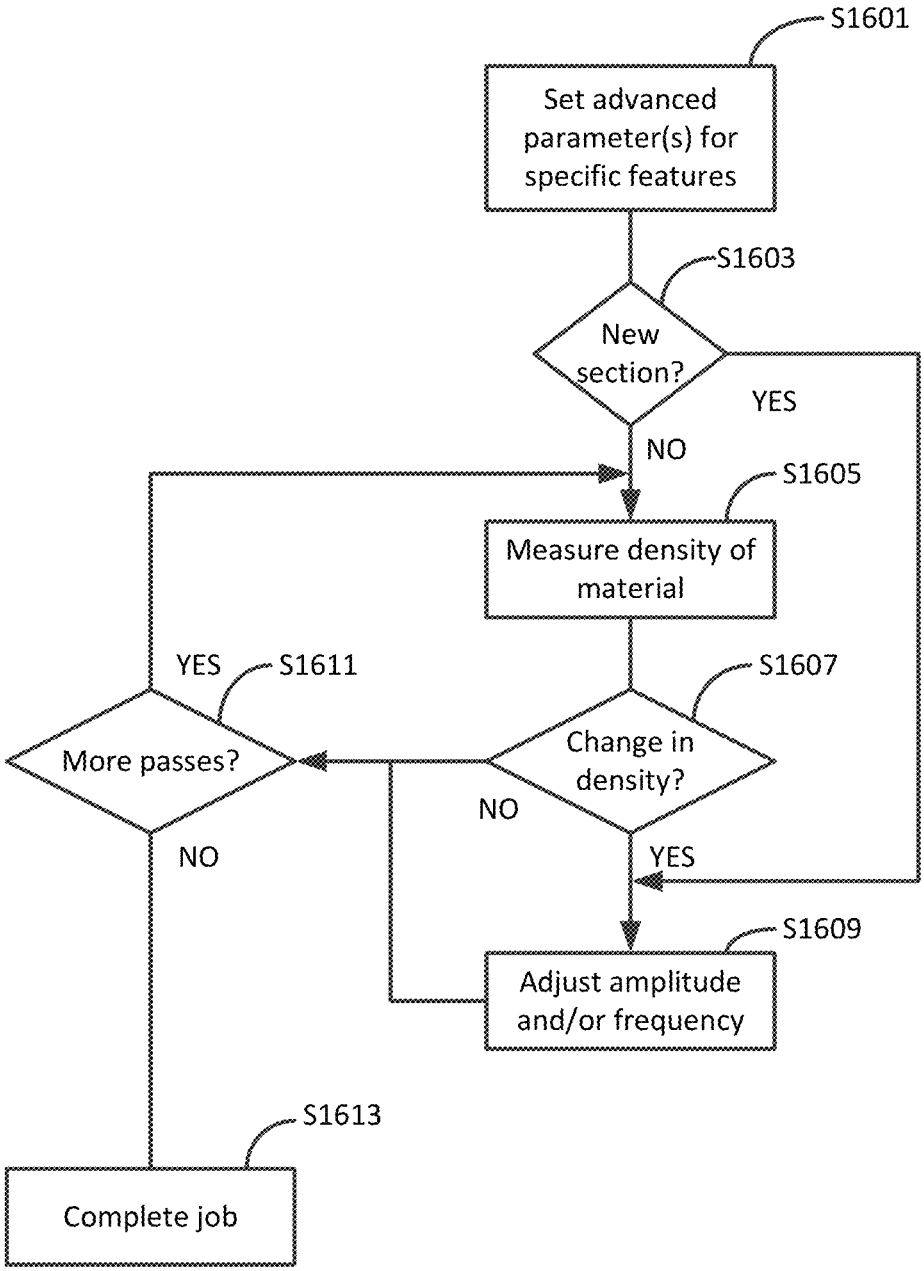
FIG. 16 is a flowchart of a method or operations in accordance with an exemplary aspect of the disclosure.

FIG. 16 is a flowchart of a method of automatic operation of a compactor machine, such as compaction machine 100 in accordance with an exemplary aspect of the disclosure. The automatic method may be performed using controller 503 or remote control system 700.

In S1601, advanced parameters for automatic operation can be set. As the compaction machine 100 is operated, in S1603, a determination is made as to whether the compaction machine 100 is at a section to be compacted. In S1605, a compaction measurement sensor 501 can be used to measure density of the material. In S1607, the results of the compaction measurement are used to determine if there is a change in density (S1607). If there is substantially no change in density (NO in S1607), in S1611, a determination is made as to whether more passes are needed. If no more passes are needed, in S1613, the job is completed. Otherwise, if there is a change in density (YES in S1607), in S1609, vibration amplitude and/or frequency may be adjusted.

In some embodiments, as an alternative to the OEM or a dealer given access to switch between groups or levels, the customer may be enabled to change between groups or levels of features and the system can inform the OEM of the changes and time in specific operating parameters. The advanced features for specific operating parameters may include (as examples):

Basic System—(e.g., 2 amplitudes)
Advanced Feature 1—(e.g., 5 amplitudes)
Advanced Feature 2—(e.g., multiple amplitudes, multiple frequencies)
Advanced Feature 3—(e.g., vibration autonomy)
Advanced Feature 4—(e.g., compaction measurement)

In order for an operator to make adjustments, the compaction machine, such as compaction machine 100, may be equipped with a programmable hardware (controller). Switching between features (basic to advance, advanced to advanced, or advanced to basic) may be facilitated by a wireless connection (e.g., cellular).

In some embodiments, a compaction machine 100 may have a control interface including a hand-operated wheel, knob, and other optional buttons and levers. Compaction with compaction measurement sensor feedback may indicate how hard the material is, which provides an indication of the number of times that the material needs to be driven over: e.g., drive over 3, 4, 5 times. The operator may select an amplitude using a hand-operated wheel. With the turning of a nob, the operator may select a desirable frequency. The operator can switch between amplitudes or frequencies while the compaction machine 100 between jobs, or while the compaction machine 100 is operating.

Numerous modifications and variations of the present disclosure are possible in light of the above teachings. It is therefore to be understood that within the scope of the appended claims, embodiments may be practiced otherwise than as specifically described herein.

The invention claimed is:

1. A vibratory compactor, comprising:
a frame;
a cylindrical drum coupled to the frame;
a shaft extending concentrically at least through a center of the drum, the shaft having a first end and a second end opposite the first end;
a vibratory system rotatably positioned within the drum to induce a vibration force on the drum; and
a control system configured to:
receive a first setting of an authorization to use a first set of selectable amplitudes of the vibration force for a first predetermined duration,
operate the vibratory compactor during the first predetermined duration by inducing the vibration force at amplitudes by the vibratory system, wherein the amplitudes of the vibration force are selected from among only the first set of selectable amplitudes, and
after the first predetermined duration, change the first setting of the authorization to use to a second setting of an authorization to use a second set of selectable amplitudes of the vibration force that is different from the first set of selectable amplitudes.

2. The vibratory compactor of claim 1, wherein the control system is configured to operate the vibratory compactor for a duration of predetermined operating hours as the first predetermined duration.

3. The vibratory compactor of claim 1,
wherein the control system is configured to receive the first setting via a secure access, and wherein the control system is configured to receive, during the first predetermined duration, via the secure access, the second setting of the authorization to use the second set of selectable amplitudes of the vibration for a second predetermined duration.

4. The vibratory compactor of claim 1, wherein the second set of selectable amplitudes of the vibration force is a basic minimum number of selectable amplitudes for any operator of the vibratory compactor.

5. The vibratory compactor of claim 1, further comprising a secure access, wherein the control system is configured to receive, during the first predetermined duration, via the secure access, the second setting of the authorization to use the second set of selectable amplitudes of the vibration force and a number of selectable frequencies for a second predetermined duration.

6. The vibratory compactor of claim 1, wherein the control system is configured to automatically switch, upon expiration of the first predetermined duration, to a different amplitude for the vibration force for a second predetermined duration.

7. The vibratory compactor of claim 6, wherein the control system is configured to receive a compaction measurement and switch to the different amplitude for the vibration force responsive to receipt of the compaction measurement.

8. The vibratory compactor of claim 1, further comprising pneumatic rear tires, wherein the control system is configured to receive, during the first predetermined duration, a setting for inflation pressure of the pneumatic rear tires, and wherein pneumatic compaction is performed based on the inflation pressure.

9. A system for enabling project specific features on an asphalt compactor, comprising:

a remote setting device configured to remotely set a vibration force of the asphalt compactor by enabling a first group of selectable amplitudes of the vibration force for a first predetermined amount of time; and a control system configured to:

receive, via a secure connection with the remote setting device, the setting to enable the first group of selectable amplitudes of the vibration force for the first predetermined amount of time, operate the asphalt compactor during the first predetermined amount of time by selecting one or more vibration amplitudes from among only the selectable vibration amplitudes of the first group and apply the vibration force to asphalt at the selected one or more vibration amplitudes, and at expiration of the first predetermined amount of time, change the setting of the vibration force by enabling a second group of selectable amplitudes of the vibration force that is different from the first group of selectable amplitudes, wherein a first total number of the selectable amplitudes of the first group of selectable amplitudes is greater than a second total number of selectable amplitudes of the second group of selectable amplitudes.

10. The system of claim 9, wherein the control system is configured to receive, at the expiration of the first predetermined amount of time, via the secure connection, a setting to enable the second group of selectable amplitudes of the vibration force for a second predetermined amount of time.

11. The system of claim 9, wherein the control system is configured to automatically switch, at the expiration of the first predetermined amount of time, to a different amplitude of the vibration force for a second predetermined amount of time.

12. The system of claim 11, further comprising a compaction measurement device, wherein the control system is configured to receive a compaction measurement from the compaction measurement device and switch to the different amplitude of the vibration force based on the compaction measurement.

13. A method of managing asphalt compactor features, comprising:

receiving, via secure access, a first setting to allow access to a first number of selectable amplitudes of a vibration force and a first number of selectable frequencies of vibration to be applied by the asphalt compactor to an asphalt surface for a first predetermined duration;

operating the asphalt compactor during the first predetermined duration by applying amplitudes and frequencies of vibration force, selected from among only the first number of selectable amplitudes and the first number of selectable frequencies of the vibration force, to the asphalt surface; and at expiration of the first predetermined duration, changing the first setting to a second setting to allow access to a second number of selectable amplitudes of the vibration force and a second number of selectable frequencies of the vibration force that are different from the first number of selectable amplitudes of the vibration force and the first number of frequencies of the vibration force, respectively.

14. The method of claim 13, further comprising operating the asphalt compactor for a duration of predetermined operating hours as the first predetermined duration.

15. The method of claim 13, further comprising receiving, after the expiration the first predetermined duration, via the secure access, the second setting to allow the access to the second number of selectable amplitudes of the vibration force for a second predetermined duration.

16. The method of claim 13, further comprising receiving, at the expiration of the first predetermined duration, via the secure access, the second setting to allow the access to the second number of selectable amplitudes of the vibration force and the second number of selectable frequencies for a second predetermined duration different from the first predetermined duration.

17. The method of claim 13, further comprising automatically switching, at the expiration of the first predetermined duration, to a different amplitude and a different frequency of the vibration force, selected from the second number of selectable amplitudes and the second number of selectable frequencies of the vibration force, respectively, for a second predetermined duration different from the first duration.

18. The method of claim 17, further comprising receiving a compaction measurement and switching to the different amplitude of the vibration force responsive to receipt of the compaction measurement.

19. The method of claim 13, wherein amplitudes of the second number of selectable amplitudes of the vibration force are included in the amplitudes of the first number of selectable amplitudes, and frequencies of the second number of selectable frequencies of the vibration force are included in the frequencies of the first number of selectable frequencies.

20. The method of claim 19, further comprising disabling, at the expiration of the first predetermined duration, the amplitudes of the first number of selectable amplitudes to obtain the amplitudes of the second number of selectable amplitudes of the vibration force, and the vibrations of the first number of selectable frequencies to obtain the frequencies of the second number of selectable frequencies of the vibration force.

* * * * *